US008496099B2

(12) United States Patent
Togiya et al.

(10) Patent No.: US 8,496,099 B2
(45) Date of Patent: Jul. 30, 2013

(54) MEDIUM PROCESSING APPARATUS

(75) Inventors: Hajime Togiya, Gunma (JP); Atsushi Takada, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/063,708

(22) PCT Filed: Jun. 2, 2010

(86) PCT No.: PCT/JP2010/059304
§ 371 (c)(1),
(2), (4) Date: Mar. 11, 2011

(87) PCT Pub. No.: WO2010/146989
PCT Pub. Date: Dec. 23, 2010

(65) Prior Publication Data

US 2011/0198192 A1 Aug. 18, 2011

(30) Foreign Application Priority Data

Jun. 17, 2009 (JP) ..... 2009-144013

(51) Int. Cl.
*G07F 7/04* (2006.01)

(52) U.S. Cl.
USPC ..... 194/206; 194/207; 271/298; 271/303

(58) Field of Classification Search
USPC ..... 194/206, 207, 302; 209/534; 271/303, 271/304, 298
See application file for complete search history.

(56) References Cited

U.S. PATENT DOCUMENTS

| | | | | |
|---|---|---|---|---|
| 6,932,208 | B1 * | 8/2005 | Wen | 194/203 |
| 2002/0162775 | A1 * | 11/2002 | Saltsov et al. | 209/534 |
| 2005/0052711 | A1 * | 3/2005 | Schaede | 358/490 |
| 2006/0163027 | A1 * | 7/2006 | Hobmeier et al. | 194/207 |
| 2007/0221469 | A1 * | 9/2007 | Katou et al. | 194/206 |
| 2009/0211874 | A1 * | 8/2009 | Oie et al. | 194/206 |

FOREIGN PATENT DOCUMENTS

| | | | |
|---|---|---|---|
| EP | 1873726 | A1 | 1/2008 |
| EP | 2333730 | A1 | 6/2011 |
| JP | 60-025064 | U | 2/1985 |
| JP | 10-167512 | A | 6/1998 |
| JP | 2000-187748 | A | 7/2000 |
| JP | 2006-065539 | A | 3/2006 |
| JP | 2008217465 | A | 9/2008 |
| WO | WO-03/077209 | A2 | 9/2003 |

* cited by examiner

*Primary Examiner* — Jeffrey Shapiro
(74) *Attorney, Agent, or Firm* — Rabin & Berdo, P.C.

(57) ABSTRACT

When a bill-jam occurs in a bill dispenser, the jammed bill or the subsequent bill is easily removed.
An arc-shaped conveyance passage (20) that is formed in an arc shape and that includes a cylindrical drive roller (21) rotating about a rotational shaft (21*a*) and plural pressure rollers (22) pressurizing an outer circumferential surface of the cylindrical drive roller, is provided in a conveyance passage connecting a discrimination part (3) to a reception part (1) in the bill dispenser. A switching blade (6) is disposed in a branch part (26) between the arc shape conveyance passage (20) and a branch conveyance passage (27) connected to a temporary holding part 4. A first unit (31) and a second unit (34) are rotated about respective rotational fulcrums (32), (35) in which the first unit (31) includes the reception part (1) and a pressure roller (22) of the arc-shaped conveyance passage (20) at the side of the reception part (1), and the second unit (34) includes the temporary holding part (4), a pressure roller (22) immediately near to the branch part (26), and the switching blade (6). The arc-shaped conveyance passage (20) is opened by rotating the first and second units (31), (34).

15 Claims, 5 Drawing Sheets

MEDIUM PROCESSING APPARATUS

TECHNICAL FIELD

The present invention relates to a medium processing apparatus such as a bill dispenser mounted on an automatic teller machine (ATM).

BACKGROUND ART

In a conventional bill dispenser as a medium processing apparatus, in a deposit transaction, when a customer inputs bill into a reception part, the bill is conveyed by a conveyance passage from the reception part to a bill discrimination part that discriminates the denomination and normal/damage of the bill. The bill determined as the normal bill by the discrimination part is conveyed by a conveyance passage and is held in a temporary holding part. On the other hand, the bill determined as the rejected bill at the time of deposit by the discrimination part is conveyed back to the reception part along the conveyance passage to be returned to the customer.

When the amount of deposit is confirmed by the customer, denomination of the bill held in the temporary holding part is discriminated again by the discrimination part, thereafter, is accommodated by the conveyance passage to respective denomination cassettes according to the denomination determined.

In a withdrawal transaction, when the customer input the amount of bill to be withdrawn, the bill is fed from the cassettes and conveyed to the discrimination part by the conveyance passage.

Then, the bill determined as the normal bill by the discrimination part is conveyed to the reception part by the conveyance passage so as to be paid out to the customer. On the other hand, the bill, which is determined as the rejected bill by the discrimination part at the time of withdrawal, is conveyed from the discrimination part to a reject storage by a conveyance passage and is accumulated in the reject storage (for example, see Japanese Patent Application Laid-Open (JP-A) No. 2008-217465 (paragraphs 0031 to 0034 and 0042 and FIGS. 4 and 7)).

DISCLOSURE OF THE INVENTION

Problems to be Solved by the Invention

In the conventional technique, since respective functional parts, such as a reception part for deposit and withdrawal for a bill, a discrimination part, a temporary holding part, denomination cassettes, and a reject storage are connected by conveyance passages, the conveyance passages have to be disposed in a narrow space within an apparatus in order to miniaturize the apparatus as small as possible. For this reason, it is necessary to form a conveyance passage with a turn portion which is bent at an angle equal to or less than 90 degrees, a wave-shaped conveyance passage wound by a belt to generate a feed force in belt conveyance, and a conveyance passage formed by a rounding route for which a distance between the discrimination part and a switching timing sensor corresponds to a length that can ensure a calculation time for discrimination performed by the discrimination part, and the like. For this reason, the structure of the conveyance passages becomes complicated. Moreover, in order to convey the bill rejected at the time of withdrawal (withdrawal rejected bill), to the reject storage, it is necessary to provide a switching blade, which switches the conveyance direction of the withdrawn rejected bill toward the reject storage located immediately behind the discrimination part, and a switching timing sensor which detects the switching timing of the switching blade. For this reason, there is a long conveyance passage for the bill at the time of deposit from the discrimination part to the temporary holding unit located on the downstream side of the discrimination part.

The bill may be easily jammed in the complicated conveyance passage or the long conveyance passage, as in the conventional art. When the jamming of the bill occurs, it is difficult to view jammed bill in the conveyance passage having the complicated conveyance route. It is necessary that, in order to view the bill and the line, the conveyance guide is finely opened, or it is viewed from a space between the belts or the like to check the remaining bill, and the jammed bill and the subsequent bill are removed, and it is problematic.

It is an object to resolve the above-mentioned problems.

Means for Solving the Problems

A medium processing apparatus is characterized in that the apparatus includes: a reception part having a deposit and withdrawal port for a bill; a discrimination part that performs discrimination relating to the bill; a temporary holding part that holds the bill; a switching blade that switches a conveyance direction of the bill that is discriminated at the discrimination part; a switching timing sensor that detects a switching timing of the switching blade; a denomination cassette that accommodates the bill; and conveyance passages connecting the respective parts, and an arc-shaped conveyance passage, formed in an arc shape, which includes a cylindrical drive roller that rotates about a rotational shaft and a plurality of pressure rollers that press an outer circumferential surface of the cylindrical drive roller, is formed in a conveyance passage connecting from the discrimination part to the reception part, the switching blade is disposed at a branch part of the arc-shaped conveyance passage and a branch conveyance passage connected to the temporary holding part, a first unit including the reception part and a pressure roller at a reception part side of the arc-shaped conveyance passage, and a second unit including the temporary holding part, a pressure roller immediately near the branch part and the switching blade, are configured to be rotatable about respective rotational fulcrums, and the arc-shaped conveyance passage is opened by rotating the first and second units.

Effects of the Invention

According to the invention, since the bill can be viewed by exposing the outer circumferential surface of the drive roller, the bill remaining in the arc shape conveyance passage can be easily removed.

BEST MODE FOR CARRYING OUT THE INVENTION

Hereinafter, exemplary embodiments of the invention will be described with reference to the drawings.

(First Exemplary Embodiment)

Figure 1:
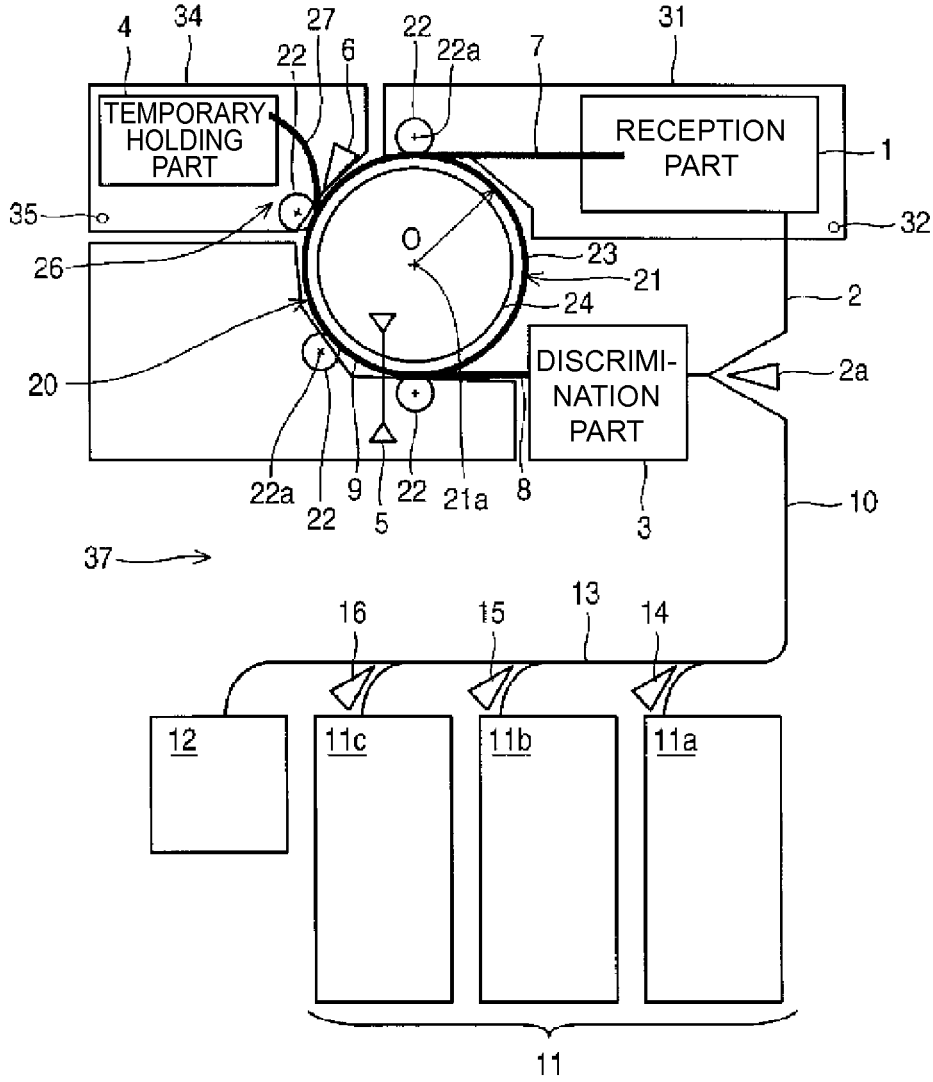
FIG. 1 is a diagram illustrating the configuration of a bill dispenser according to a first exemplary embodiment.

FIG. 1 is a diagram illustrating the configuration of a bill dispenser according to a first exemplary embodiment.

In FIG. 1, a reception part 1 has a money deposit and withdrawal port through which bill to be deposited is input and bill to be withdrawn is received. A conveyance passage 2 is a passage along which the bill separated and conveyed from the reception part 1 is conveyed. A switching blade 2*a* is disposed at the conveyance passage 2 at halfway thereof. A discrimination part 3 performs variety of discriminations relating to bill, such as denomination, normal/damage, and conveyance status of bill. A temporary holding part 4 accumulates and temporarily holds normal bill taken-in at the time of deposit and withdrawal rejected bill and the like.

An optical type switching timing sensor 5 detects a switching timing of a switching blade 6 that switches the conveyance direction of bill toward the reception part 1 or toward the temporary holding part 4. A conveyance passage 7 is a passage which returns rejected bill at the time of deposit (deposit rejected bill), which is determined as abnormally conveyed bill, damaged bill or the like by the discrimination part 3, to the reception part 1. A conveyance passage 8 is a passage which is from the discrimination part 3 to the switching timing sensor 5. A conveyance passage 9 is a passage which is from the switching timing sensor 5 to the switching blade 6. A conveyance passage 10 is a passage connected between the switching blade 2*a* on the conveyance passage 2 and a denomination cassette 11 capable of accommodating and feeding.

The denomination cassette 11 includes plural cassettes 11*a*, 11*b*, and 11*c* which accommodate bills respectively according to the denominations that are set. Moreover, the number of denomination cassettes 11 is not limited to three but may be set to any number.

A reject storage 12 accommodates withdrawal rejected bill and the bill that is accidently left. A distribution conveyance passage 13 is a passage which is from the denomination cassette 11 passing to the reject storage 12. A blade 14 distributes bill to the denomination cassette 11*a*. A blade 15 distributes bill to the denomination cassette 11*b*. A blade 16 distributes bill to the denomination cassette 11*c*.

Vertical and horizontal dimensions of the bill dispenser are regulated normally, and it is necessary that the bill input through the reception part 1 is returned again to the reception part 1. Therefore, the conveyance passage 8, the conveyance passage 9, and the conveyance passage 7 are connected in a loop shape between the discrimination part 3 and the reception part 1.

In the conveyance passage in a loop shape connected from the discrimination part 3 to the reception part 1, the bend of the turn portion becomes sharp if plural rollers forming this conveyance passage are connected straight in a tangential direction.

Accordingly, it is necessary to shorten the conveyance route connected from the discrimination part 3 to the reception part 1 and to eliminate the sharp bend of the turn portion. For this reason, in this exemplary embodiment, an arc shape conveyance passage 20 in which, between rollers, are connected with a relatively large circular arc (in this exemplary embodiment, a half-arc) is formed in a portion of the conveyance passage 8, the conveyance passage 9, and the conveyance passage 7 connecting between the discrimination part 3 and the reception part 1.

As shown in FIG. 1, the arc shape conveyance passage 20 according to this exemplary embodiment is formed by a cylindrical drive roller 21 and a plural pressure rollers 22 disposed circumference of the drive roller 21. With such a configuration, the conveyance passage formed in the arc is a conveyance passage having a turn portion with a gentle curvature.

The drive roller 21 is rotatably driven in backward and forward directions about a rotational shaft 21*a*, which is disposed in a direction perpendicular to a conveyance direction of the bill to a curvature center O (which is an intersection point between two normal lines of the arc) of the arc shape conveyance passage 20, by a power source (not shown in the drawings).

The pressure rollers 22 are disposed to face the drive roller 21 in a radial direction from the arc curvature center O of the arc conveyance passage 20 at the outer side. The pressure roller 22 is disposed on a rotational shaft 22*a* disposed in parallel with the rotational shaft 22*a* of the drive roller 21. Moreover, the pressure roller 22 is pressed against the outer circumferential surface of the drive roller 21 by a spring member (not shown in the drawings) so as to be driven-rotated with the rotation of the drive roller 21.

Figure 2:
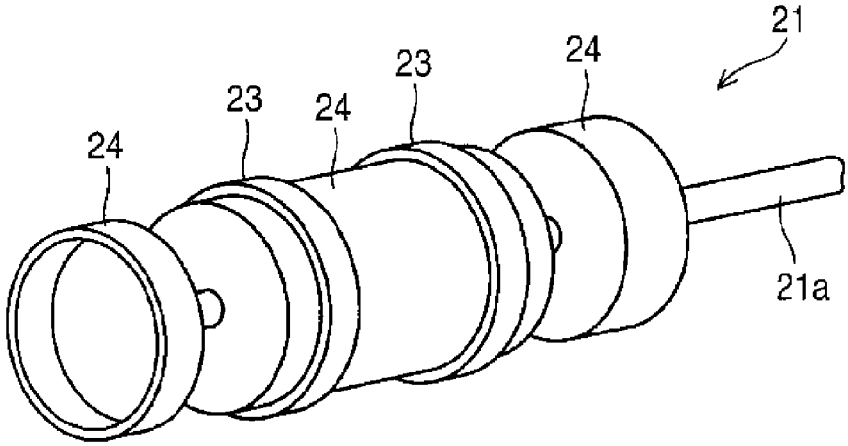
FIG. 2 is a perspective view illustrating a drive roller according to the first exemplary embodiment.

As shown in FIG. 2, the drive roller 21 is provided with frictional members 23 made of rubber or the like in portions coming into contact with each pressure roller 22 shown in FIG. 1. The outer circumferential surface of the frictional member 23 is formed to have a radius r with the center O of the rotational shaft 21*a* being as its center, thereby forming a conveyance passage in arc form of the arc shape conveyance passage 20.

Portion other than the frictional members 23 are formed by a cylindrical transparent member with a smaller diameter. The outer circumferential surface of the portions serve as guide surfaces 24 guiding the bill sandwiched and conveyed between the frictional member 23 and the pressure rollers 22.

A branch part 26 provided with the switching blade 6 is disposed between the adjacent pressure rollers 22 in the arc conveyance passage 20. A conveyance direction is switched to the branch conveyance passage 27 connected from the branch part 26 to the temporary holding part 4 by the switching blade 6.

A first unit 31 is a unit in which the reception part 1, the pressure roller 22 of the arc conveyance passage 20 at the side of the reception part 1, the conveyance passage 7 connecting the arc shape conveyance passage 20 to the reception part 1, and the like are integrally structured.

Figure 3:
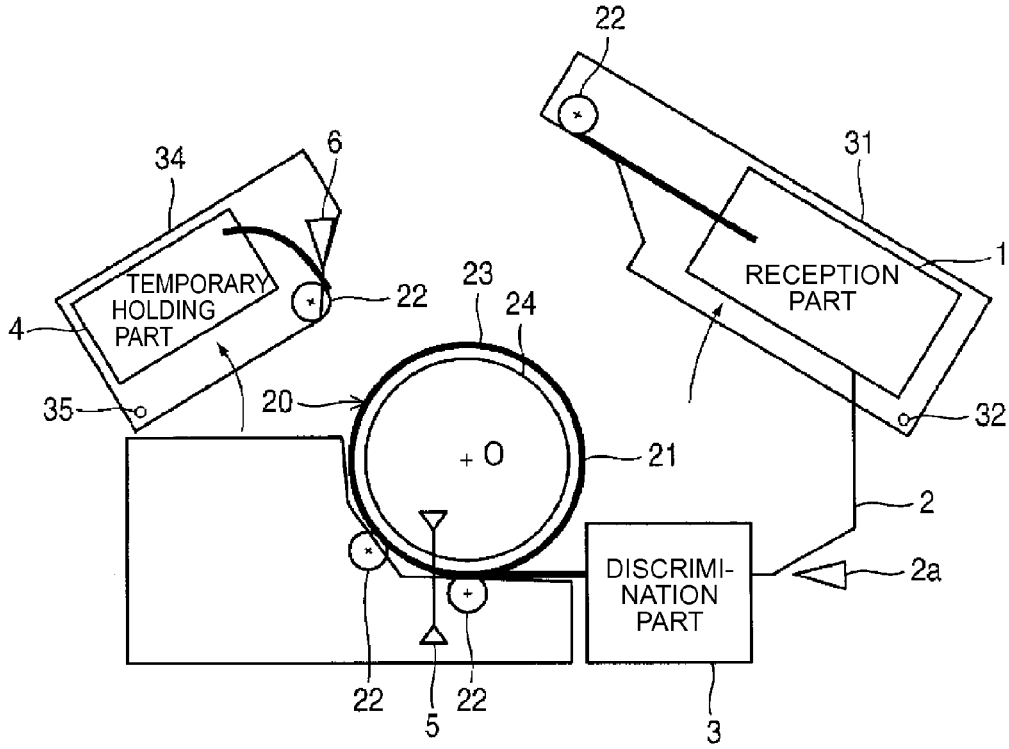
FIG. 3 is a diagram illustrating an operation status of the bill dispenser according to the first exemplary embodiment.

The first unit 31 is rotatably supported by a rotational fulcrum 32 at one end thereof. When the first unit 31 is rotatably moved, as shown in FIG. 3, the pressure roller 22 and the like get apart from the drive roller 21, so that a portion of the arc shape conveyance passage 20 around the drive roller 21 is opened.

A second unit 34 is a unit in which the temporary holding unit 4, the pressure roller 22 immediately near to the branch part 26, the switching blade 6, the branch conveyance passage 27, and the like are integrally structured.

The second unit 34 is rotatably supported by a rotational fulcrum 35 at one end thereof. As shown in FIG. 3, when the second unit 34 is rotatably moved, the pressure roller 22 and the like get apart from the drive roller 21, and a portion of the arc shape conveyance passage 20 around the drive roller 21 is opened.

A fixed unit 37 is a unit in which the drive roller 21 itself, the pressure rollers 22 other than the pressure rollers 22 of the units 31 and 34, the conveyance passage 2, the conveyance passage 8, the conveyance passage 9, the conveyance passage 10, and the denomination unit 11 and the like are integrally structured.

Hereinafter, an operation of the above-described configuration will be described.

When the bills received in the reception part 1 is separated sheet by sheet, a monitoring sensor (not shown in the drawings) determines that the bills can be separated and then the bill is fed out to the conveyance passage 2.

The fed bill is conveyed to the discrimination part 3 by the conveyance passage 2. After the discrimination part 3 discriminates the bill, the normal bill passes through the conveyance passage 8 and the conveyance passage 9, with the switching blade 6 being switched, and, by the branch conveyance passage 27, is accumulated and taken into the temporary holding part 4. On the other hand, the deposit rejected bill passes through the conveyance passage 8 and the conveyance passage 9, with the switching blade 6 being switched, and passes through the conveyance passage 7 to be conveyed to the reception part 1.

When the bill is accommodated in the denomination cassette 11 after confirmation of the deposit, the bill fed from the temporary holding part 4 is, with the switching blade 6 being switched, conveyed to the discrimination part 3 by the conveyance passage 9 and the conveyance passage 8 so that the bill is discriminated once again. Further, the bill is, with the switching blade 2*a* being switched, conveyed by the conveyance passage 10 to the denomination cassettes 11*a* to 11*c* so as to be accommodated therein according to the kinds of discriminated denomination.

When the bill is withdrawn, the bill is fed from the denomination cassettes 11*a* to 11*c*, and conveyed by the conveyance passage 10. Then, with the switching blade 2*a* being switched, the bill is conveyed to the discrimination part 3 by the conveyance passage 2. After the bill is discriminated by the discrimination part 3, the withdrawal rejected bill is conveyed by the conveyance passages 8 and 9, and, with the switching blade 6 being switched, the bill is accumulated in the temporary holding part 4. On the other hand, the withdrawn bill passes through the conveyance passage 8 and 9, and is then conveyed to the reception part 1 in passing through the conveyance passage 7.

Moreover, the withdrawal rejected bill, which is temporarily accumulated in the temporary holding part 4 at the time of withdrawal, is fed from the temporary holding part 4 and is then conveyed to and accommodated in the reject storage 12 by the similar way of the accommodation operation at the time of deposit, after the withdrawn transaction ends for example.

When bill that is conveyed along the arc shape conveyance passage 20 during the deposit operation or the withdrawal operation is jammed, either or both of the first unit 31 and the second unit 34 are rotatably moved about the rotational fulcrums 32 and/or 35, as shown in FIG. 3, to release the arc shape conveyance passage 20. The jammed bill and the subsequent bill are removed with exposing the outer circumferential surface of the drive roller 21. After the removal of the subsequent bill and the like, the rotated first unit 31 and/or the rotated second unit 34 are closed and the deposit operation or the withdrawal operation is performed again.

In this exemplary embodiment, the guide surfaces 24 of the drive roller 21 are made of a transparent member. Therefore, although a conveyance guide of the conveyance passage 8 and the like from the discrimination part 3 is not released, the bill remaining on the drive roller 21 can be viewed.

The arc shape conveyance passage 20 is formed in a portion of the conveyance passage connected from the discrimination part 3 to the reception part 1. The conveyance route is short and the curve of the turn portion is gentle. Such a configuration can suppress the jam of the bill The bill conveyed from the discrimination part 3 is sandwiched between the frictional member 23 and the pressure roller 22 and is conveyed with the rotation of the drive roller 21. Thus, the bill is conveyed in a state where the drive roller 21 and the bill are relatively stopped. Accordingly, the collision and catching of the bill to a conveyance guide are reduced, the bill is further suppressed from being jammed.

Moreover, since the bill and the drive roller 21 are not relatively moved, static electricity caused by the friction is not likely to be generated. Thus, a noise can be reduced in an electric circuit and sticking of the bill to the drive roller 21 can be prevented.

The arc shape conveyance passage 20 according to this exemplary embodiment is formed by the cylindrical drive roller 21 provided with the frictional members 23 and the guide surfaces 24, and the pressure rollers 22 pressurizing the outer circumferential surface of the frictional members 23. That is, since the guide surface 24 of the drive roller 21 also serves as the conveyance guide, a simple structure can be realized and thus the conveyance passage can be configured at low cost.

As described above, a first unit including the reception part and the pressure roller of the arc shape conveyance passage at the side of the reception part, and a second unit including the temporary holding part, the pressure roller immediately near the branch part, and the switching blade, are configured to be rotatable about respective rotational fulcrums. Existence of the jammed bill can be viewed by opening the arc shape conveyance passage by the rotational movement of the first and second units so as to expose the outer circumferential surface of the drive roller, so the jammed bill on arc shape conveyance passage can easily be removed, Moreover, since the drive roller is formed by the transparent member, the bill remaining on the drive roller can easily be viewed.

(Second Exemplary Embodiment)

In this exemplary embodiment, the configuration of the drive roller according to the above-described first exemplary embodiment is modified.

Figure 4:
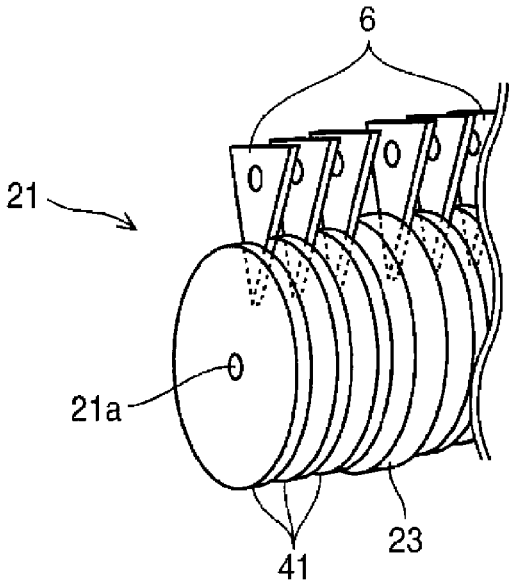
FIG. 4 is a perspective view illustrating a drive roller according to a second exemplary embodiment.
Figure 5:
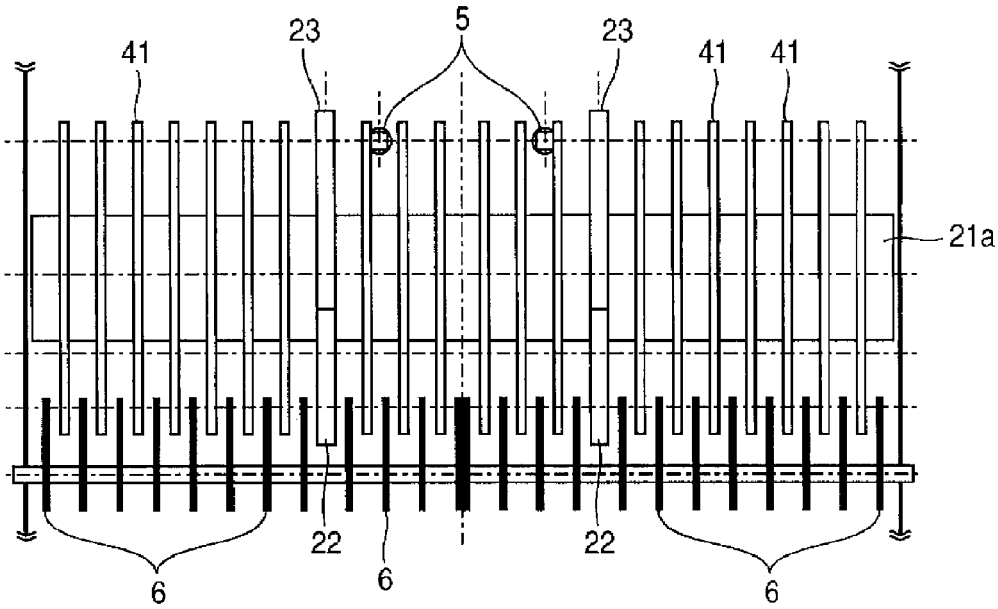
FIG. 5 is a front view illustrating the drive roller according to the second exemplary embodiment.

FIG. 4 is a perspective view illustrating a drive roller. FIG. 5 is a front view illustrating the drive roller. The same reference numerals are given to the same constituent elements as those of the first exemplary embodiment, and the description thereof will not be repeated.

A drive roller 21 according to this exemplary embodiment has a configuration in which the centers of circular plates 41 are attached to the rotational shaft 21*a* at interval therebetween in rib manner, as shown in FIGS. 4 and 5. The tip end portions of the switching blades 6 are entered between the circular plates 41 so as to be in alternate manner. The circular plate 41 has the same diameter as that of the guide surface 24 of the above-described first exemplary embodiment and is configured to guide the bill being conveyed.

The circular plates 41 provided with the frictional member 23 similar to that of the above-described first exemplary embodiment on the outer circumference thereof are arranged at an interval narrower than the length of the bill in a direction perpendicular to the conveyance direction of the bill, at the rotational shaft 21*a*. The diameter of the outer circumferential surface of the frictional member 23 is the same as the diameter of the outer circumferential surface of the frictional member 23 of the above-described second exemplary embodiment. The pressure rollers 22 (see FIG. 5) are arranged to face the outer circumferential surface of the frictional member 23.

A circular plate 41 whose entire portion is configured with the frictional member 23 may be similar to the circular plate 41 on which the frictional member 23 is attached. The width of the circular plate 41 provided with the frictional member 23 is larger than the width of the other circular plate 41.

However, the width of the circular plate 41 provided with the frictional member 23 may be the same as the width of the other circular plate 41.

As shown in FIG. 5, the switching timing sensors 5 according to this exemplary embodiment are disposed between the circular plates 41, and the optical axis thereof passes through between the circular plates 41.

In this exemplary embodiment, as in the first exemplary embodiment, when bill that is conveyed along the arc shape conveyance passage 20 during the deposit operation or the withdrawal operation is jammed, either or both of the first unit 31 and the second unit 34 are rotatably moved about the rotational fulcrums 32 and/or 35, to release the arc shape conveyance passage 20. The jammed bill and the subsequent bill are removed with exposing the outer circumferential surface of the drive roller 21. Thereafter, the rotated first unit 31 and/or the rotated second unit 34 are closed and the deposit operation or the withdrawal operation is performed again.

In this exemplary embodiment, since the drive roller 21 is formed by the plural circular plates disposed at interval therebetween. Therefore, although a conveyance guide of the conveyance passage 8 and the like from the discrimination part 3 is not released, the bill remaining on the drive roller 21 can be viewed.

The drive roller according to this exemplary embodiment is formed by the circular plates 41 attached in a rib manner. Therefore, since the conveyance direction of the bill which is sandwiched between the frictional members 23 of the drive roller 21 and the pressure rollers 22 and conveyed can be switched by the switching blades 6 inserted between the circular plates 41, a smooth direction switching is possible.

By disposing the switching timing sensor 5 between the circular plates 41, a switching timing sensor 5 can be mounted on the outside of the drive roller 21. Therefore, attachment can be performed with simple structure and the attachment structure with strong strength can be realized.

Thus, it is possible to obtain the same effects as those of the first exemplary embodiment. Moreover, by configuring the drive roller by the plural circular plates disposed at interval therebetween, the bill remaining on the drive roller can be easily viewed.

DESCRIPTION OF THE REFERENCE NUMERALS

1 reception part
2, 7, 8, 9, 10 conveyance passage
3 discrimination part
4 temporary holding part
5 switching timing sensor
11 denomination cassette
12 reject storage
13 distribution conveyance passage
14, 15, 16 blade
20 arc shape conveyance passage
21 drive roller
21*a* rotational shaft
22 pressure roller
23 frictional member
24 guide surface
27 branch conveyance passage
31 first unit
32, 35 rotation fulcrum
34 second unit
37 fixed unit
41 circular plate

What is claimed is:

1. A medium processing apparatus comprising:

a reception part having a deposit and withdrawal port for a bill;

a discrimination part that performs discrimination relating to the bill;

a temporary holding part that holds the bill;

a switching blade that switches a conveyance direction of the bill that is discriminated at the discrimination part;

a switching timing sensor that detects a switching timing of the switching blade;

a denomination cassette that accommodates the bill; and a conveyance passage connecting from the discrimination part to the reception part, wherein an arc-shaped conveyance passage, formed in an arc shape, which includes a cylindrical drive roller that rotates about a rotational shaft and a plurality of pressure rollers that press an outer circumferential surface of the cylindrical drive roller such that a bill conveyed path along which a bill is conveyed is formed between the outer circumferential surface of the cylindrical drive roller and the plurality of pressure rollers, is formed in the conveyance passage, wherein the switching blade is disposed at a branch part of the arc-shaped conveyance passage and a branch conveyance passage connected to the temporary holding part, wherein a first unit including the reception part and a pressure roller at a reception part side of the arc-shaped conveyance passage is configured to be rotatable about a rotational fulcrum of the first unit, and a second unit including the temporary holding part, a pressure roller immediately near the branch part and the switching blade is configured to be rotatable about a rotatable fulcrum of the second unit, and a portion of the bill conveyed portion of the arc-shaped conveyance passage is exposed by rotating the first unit such that the pressure roller at the reception part side is apart from the drive roller, and another portion of the bill conveyed portion of the arc-shaped conveyance passage is exposed by rotating the second unit such that the pressure roller immediately near the branch part is apart from the drive roller.

2. The medium processing apparatus of claim 1, wherein the drive roller is formed from a transparent material.

3. The medium processing apparatus of claim 1, wherein the drive roller is formed by a plurality of circular plates arranged on the rotational shaft with an interval therebetween.

4. The medium processing apparatus of claim 1, wherein the drive roller is provided with a frictional member in a portion facing to the pressure rollers.

5. The medium processing apparatus of claim 3, wherein a tip end portion of the switching blade is entered between the circular plates.

6. The medium processing apparatus of claim 3, wherein a frictional member is provided at an outer circumferential surface of one of the circular plates, which faces to the pressure rollers.

7. The medium processing apparatus of claim 3, wherein the switching timing sensor is disposed between the circular plates.

8. A medium processing apparatus comprising:

a reception part having a deposit and withdrawal port for a bill;

a discrimination part that performs discrimination relating to the bill;

a temporary holding part that holds the bill;

a switching blade that switches a conveyance direction of the bill that is discriminated at the discrimination part;

a switching timing sensor that detects a switching timing of the switching blade;

a denomination cassette that accommodates the bill; and a conveyance passage connecting from the discrimination part to the reception part, wherein an arc-shaped conveyance passage, formed in an arc shape, which includes a cylindrical conveyance member that rotates about a rotational shaft and a plurality of sandwiching members that sandwich the bill with an outer circumferential surface of the conveyance member such that a bill conveyed portion at which the bill is conveyed is configured between the outer circumferential surface of the conveyance member and the plurality of sandwiching members, is formed in the conveyance passage, wherein the switching blade is disposed at a branch part of the arc-shaped conveyance passage and a branch conveyance passage connected to the temporary holding part, wherein a first unit including the reception part and a sandwiching member at a reception part side of the arc-shaped conveyance passage is configured to be rotatable about a rotational fulcrum of the first unit, and a second unit including the temporary holding part and a sandwiching member immediately near the branch part and the switching blade is configured to be rotatable about a rotational fulcrum of the second unit, and wherein a portion of the bill conveyed portion of the arc-shaped conveyance passage is exposed by rotating the first unit such that the sandwiching member at the reception part side is spaced apart from the cylindrical conveyance member, and another portion of the bill conveyed portion of the arc-shaped conveyance passage is exposed by rotating the second unit such that the sandwiching member immediately near the branch part is spaced apart from the drive roller.

9. The medium processing apparatus of claim 8, wherein the sandwiching members are roller members.

10. A medium processing apparatus, comprising:

a rotatably mounted drive roller;

a first unit that includes a first pressure roller and a reception part having a port for receiving or dispensing a flexible medium, the first unit being pivotably mounted adjacent the drive roller and being pivotable between an open position and a closed position, the first pressure roller being spaced apart from the drive roller in the open position and being disposed closely adjacent the drive roller in the closed position;

a second unit that includes a second pressure roller and a temporary holding part for temporarily holding the medium, the second unit being pivotably mounted adjacent the drive roller and being pivotable between an open position and a closed position, the second pressure roller being spaced apart from the drive roller in the open position and being disposed closely adjacent the drive roller in the closed position;

a third unit that includes at least one additional pressure roller disposed closely adjacent the drive roller;

a discrimination part for discriminating the flexible medium, the discrimination part being disposed adjacent the drive roller, wherein a portion of a medium transfer path between the discrimination part and the reception part extends between the drive roller and the pressure rollers.

11. The medium processing apparatus of claim 10, further comprising a switching blade for selectively diverting the medium from the medium transfer path toward the temporary holding part.

12. The medium processing apparatus of claim 10, wherein the drive roller comprises a transparent element.

13. The medium processing apparatus of claim 10, wherein the drive roller comprises a plurality of spaced-apart plates that are disk-shaped, and further comprising a plurality of movably mounted switching blades for selectively diverting the medium from the medium transfer path to the temporary holding part, the switching blades having ends that are movable between the plates.

14. The medium processing apparatus of claim 10, wherein the drive roller comprises a friction member for engaging the medium.

15. The medium processing apparatus of claim 10, wherein the portion of the medium transfer path that extends between the drive roller and the pressure rollers wraps around about half of the drive roller.

* * * * *